US006764398B2

(12) United States Patent
Stone et al.

(10) Patent No.: US 6,764,398 B2
(45) Date of Patent: Jul. 20, 2004

(54) GAMING DEVICE AND METHOD

(75) Inventors: Jay Stone, Las Vegas, NV (US); Steven A. Weiss, Las Vegas, NV (US); Kim Tempest, Las Vegas, NV (US)

(73) Assignee: Aristocrat Technologies Australia PTY, LTD, Las Vegas, NV (US)

( * ) Notice: Subject to any disclaimer, the term of this patent is extended or adjusted under 35 U.S.C. 154(b) by 0 days.

(21) Appl. No.: 09/967,515

(22) Filed: Sep. 28, 2001

(65) Prior Publication Data

US 2003/0064785 A1 Apr. 3, 2003

(51) Int. Cl.[7] ..... A63F 9/24
(52) U.S. Cl. ..... 463/25; 463/19; 463/20
(58) Field of Search ..... 273/143 R, 236–237, 273/269, 121 B, 272–274, 292–293, 138.1, 138.2, 139, 459, 460; 463/16–22, 9–13, 25–26, 30, 36, 40–42

(56) References Cited

U.S. PATENT DOCUMENTS 5,393,057 A * 2/1995 Marnell, II ..... 273/85 CP
5,647,798 A * 7/1997 Falciglia ..... 463/19
5,788,573 A * 8/1998 Baerlocher et al. ..... 463/16
6,159,097 A * 12/2000 Gura ..... 463/20
6,190,255 B1 * 2/2001 Thomas et al. ..... 463/20
6,203,429 B1 * 3/2001 Demar et al. ..... 463/20
6,315,660 B1 * 11/2001 DeMar et al. ..... 463/16
6,443,837 B1 * 9/2002 Jaffe et al. ..... 463/16
6,454,649 B1 * 9/2002 Mattice et al. ..... 463/17
6,520,856 B1 * 2/2003 Walker et al. ..... 463/21

FOREIGN PATENT DOCUMENTS

GB 2242300 A * 9/1991 ..... G07F/17/34

* cited by examiner

*Primary Examiner*—Mark Sager
(74) *Attorney, Agent, or Firm*—Bernhard Kreten

(57) ABSTRACT

A method and device for gaming, in which a primary game is played toward a winning outcome, and in which a secondary game is played concurrently with the primary game, using outcomes on the primary game to determine the outcome of the secondary game. The secondary game is entirely different from the primary game, and play continues on the secondary game through successive primary games. The player may increase the chances of winning the secondary game by either increasing the wager, which increases the total number of outcomes that apply to the secondary game, or by choosing a variation of the secondary game that has more winning outcomes possible.

22 Claims, 3 Drawing Sheets

GAMING DEVICE AND METHOD

FIELD OF THE INVENTION

The following invention is generally related to instrumentalities and methodologies in gaming devices. More specifically, the instant invention is directed to a gaming device having a primary game and a secondary game, with the play of the secondary game dependent on the outcome of the primary game. Play of the secondary game continues over successive gaming sessions of the primary game until the player wins or until the player chooses a different version of the secondary game. The primary game contains indicia of various types that affect the secondary game differently. Most specifically, the instant invention is directed to a gaming device in which the chances of achieving a desired outcome, with respect to the secondary game, may be maximized by a player. This is accomplished by either choosing a secondary game with greater chances of winning, and/or by increasing the wager, which puts more indicia into play on the primary game.

BACKGROUND OF THE INVENTION

The primary purpose of playing any game is to win the game. While a player may initially find enjoyment in trying to win a particular game, tedium sets in if no further stimulus is offered to entertain the player. Accordingly, several games have been developed that offer a "bonus" game for attaining a particular outcome, allowing the player the prospect of engaging in a different gaming proposition. Generally, such bonus games are enabled by a "triggering" outcome. When the triggering outcome appears, a secondary game screen appears, and the secondary game is played independently of the primary game. When the secondary game ends, the player returns to the primary game, with no further incentive to continue play, except for the prospect of another chance at the bonus game. Secondary games are usually not triggered very often; even if the player enjoys playing the secondary game, there are not many chances to do so. Additionally, most games, whether primary or secondary, do not allow a player to control any aspects of the game, except in the case of enabling several paylines by making additional wagers. These factors, embodying much passivity, combine to produce stagnation, in which the player succumbs to a short attention span, and ends the gaming session.

SUMMARY OF THE INVENTION

The present invention is distinguishable over the prior art in a multiplicity of ways. For example, the instant invention rewards a player for winning outcomes on a primary game, and affords an opportunity to engage in a completely different type of gaming proposition.

Further, the instant invention allows a player to engage in a second gaming proposition concurrently with the primary game.

Further, the instant invention provides a player with the opportunity to engage in a more involved secondary gaming proposition, in which play continues through successive sessions of the primary game.

Further, the instant invention encourages a player to affect the possible outcome of the secondary game by increasing the wager.

Further, the instant invention permits a player to maximize the chance of winning by allowing the player to choose a secondary game which will win more often.

OBJECTS OF THE INVENTION

Accordingly, it is a primary object of the present invention to provide a new and novel device and method for gaming, in which a player has the opportunity to play a secondary game for more chances at success.

It is a further object of the present invention to provide a device and method as characterized above which provides a player with the prospect of engaging in different types of gaming propositions concurrently in one gaming session.

It is a further object of the present invention to provide a device and method as characterized above, in which play of a secondary game spans several successive sessions of the primary game.

It is a further object of the present invention to provide a device and method as characterized above to offer a player the opportunity to increase the chance of winning by allowing the player to choose which secondary game is played.

It is a further object of the present invention to provide a device and method as characterized above to allow the player to increase the chance of winning by placing additional wagers, which affect the total number of favorable outcomes in the secondary game.

Viewed from a first vantage point, it is an object of the present invention to provide a device for gaming, comprising, in combination a display, a wagering means, and a processor operatively coupled to said display and activated by said wagering means, said display when enabled including a plurality of indicia having means for bestowing credits, said indicia categorized into classes, each said class having differing said credit-bestowing means associated with said class.

Viewed from a second vantage point, it is an object of the present invention to provide a method for gaming, the steps including receiving a wager, enabling a display upon receipt of the wager, providing a plurality of indicia, categorizing the indicia as a function of classes, and bestowing on the classes different attributes leading to credits, whereupon during play the classes affect outcome.

These and other objects will be made manifest when considering the following detailed specification when taken in conjunction with the appended drawing figures.

DESCRIPTION OF PREFERRED EMBODIMENTS

Figure 2:
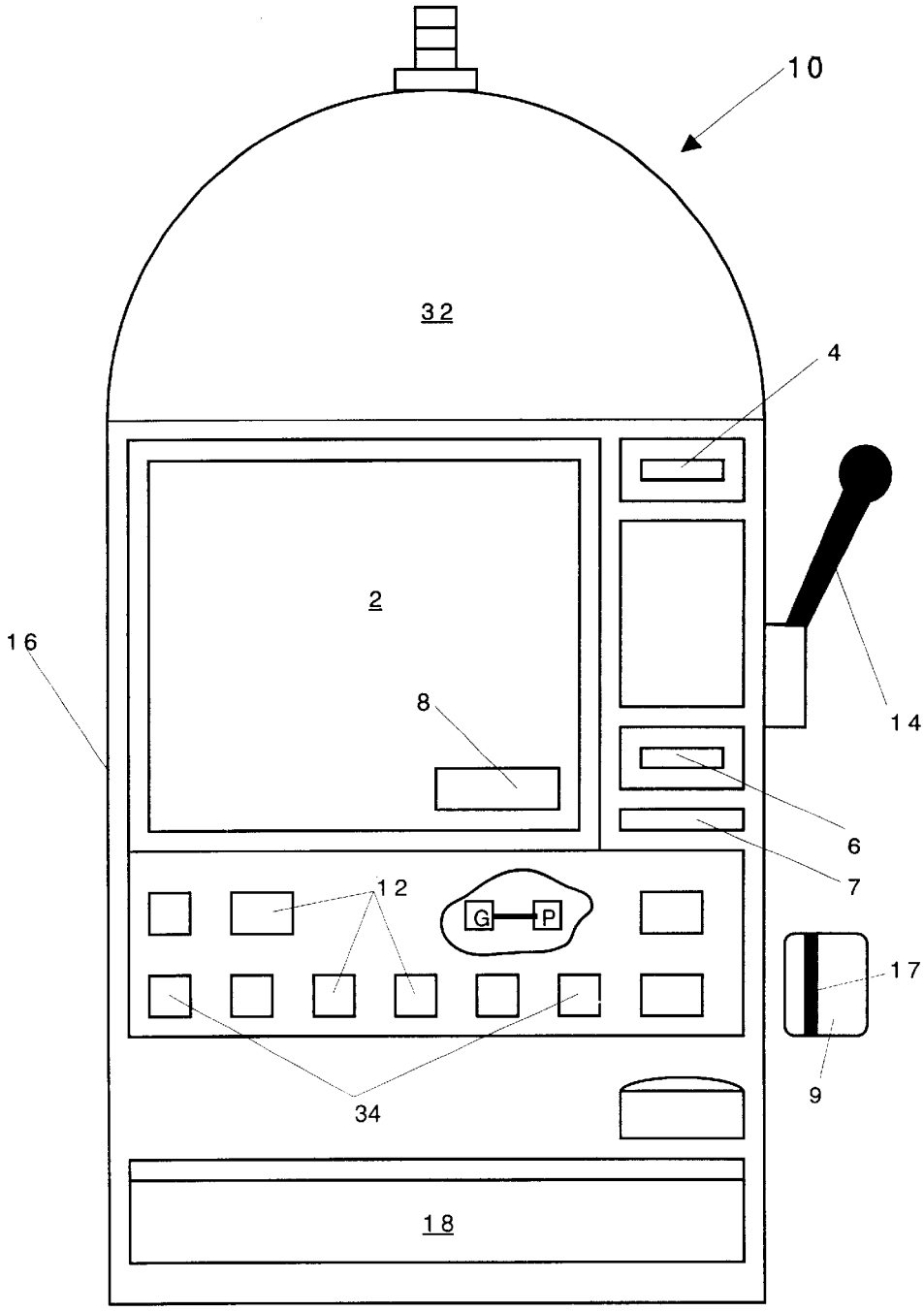
FIG. 2 is a depiction of the apparatus associated therewith.

Considering the drawings, wherein like reference numerals denote like parts throughout the various drawing figures, reference numeral 10 as shown in FIG. 2 is directed to the device according to the present invention.

In its essence, the device 10 includes a housing 16 which supports a visual display 2, preferably a video monitor, therewithin. The display 2 may include a window 8 for special messages or for incrementing counting of credits accumulated by the player. The device also includes an LED or other readout 4 for prompting the player and can provide similar verbiage as the window 8 or in lieu thereof, to stimulate the player. The device includes an inlet 6 for the reception therein for coins, currency or the like to auger in the inception of play. A plurality of decision-making buttons 12 are located on the face of the apparatus 10, preferable below the display 2, and a pull handle 14 can be used to initiate play as an alternative to supplement the decision-making buttons 12. A coin hopper 18 or other payment methods, i.e., ticket printers, may be included to effectuate an output of an award due the player. The device 10 may have a top portion 32 with a display thereon having a motif correlative with the game to be played and can include a paytable. A plurality of speakers 34 may be included on the device for aural interaction with the player. The apparatus also includes a processor P coordinating all functions and a random number generator G operatively coupled thereto for generating outcomes. A card 9, having a read/write instrumentality 17 thereon, can be read via input 7 as a substitute for or supplement to credit transfers as well as player identification.

Figure 3:
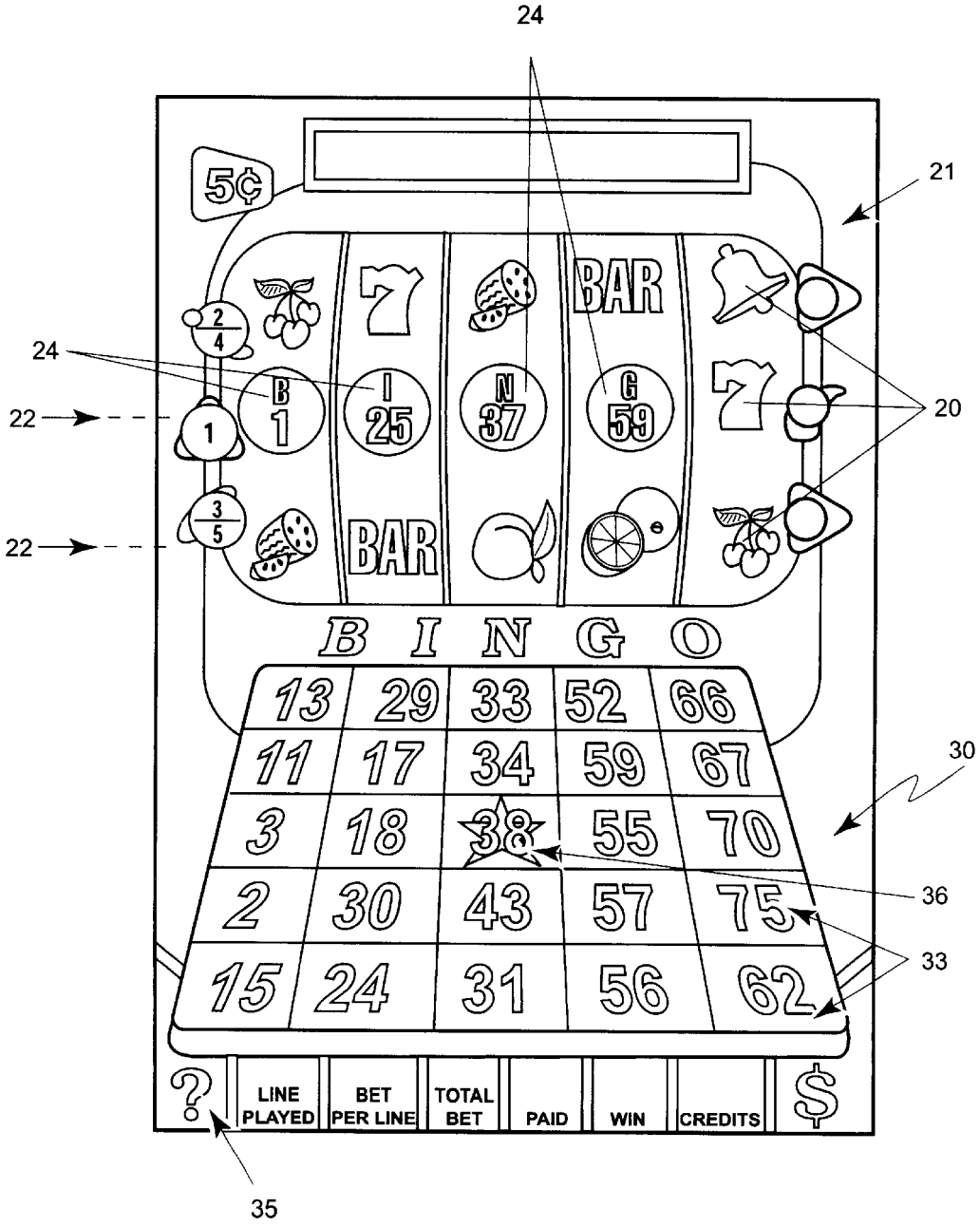
FIG. 3 is a depiction of the display of FIG. 2, depicting a primary row and column (RXC) matrix located above a plurality of randomly-numbered positions in a secondary row and column (RXC) matrix.

More specifically, and with reference to FIG. 3, greater details with respect to the video display 2 can be explored. The display 2 features a plurality of symbols 20 arranged in a primary row and column (RXC) matrix 21, corresponding to a primary game. Paylines 22 correspond to areas on the primary matrix 21 in which winning combinations may be located. The primary game is preferably a reel-type game, well known in the art, with multiple paylines, displaying three rows on five reels (a 3×5 matrix). Winning on the primary game involves aligning symbols on a payline 22 recognized in a paytable (e.g. three cherries). Below the primary matrix 21, the display 2 features a plurality of randomly-numbered positions 33 in a secondary row and column (RXC) matrix 30. Numbers for play by the device are randomly generated for play on the matrix 30. Preferably, the matrix defines a 5×5 array, correlative of BINGO, and above row one depicts the letters "BINGO," defining with positions 33 an alphanumeric display. Also located on the display 2, preferably in a lower corner, a BINGO game-type indicator 35 displays the variation of BINGO currently in play.

Figure 1:
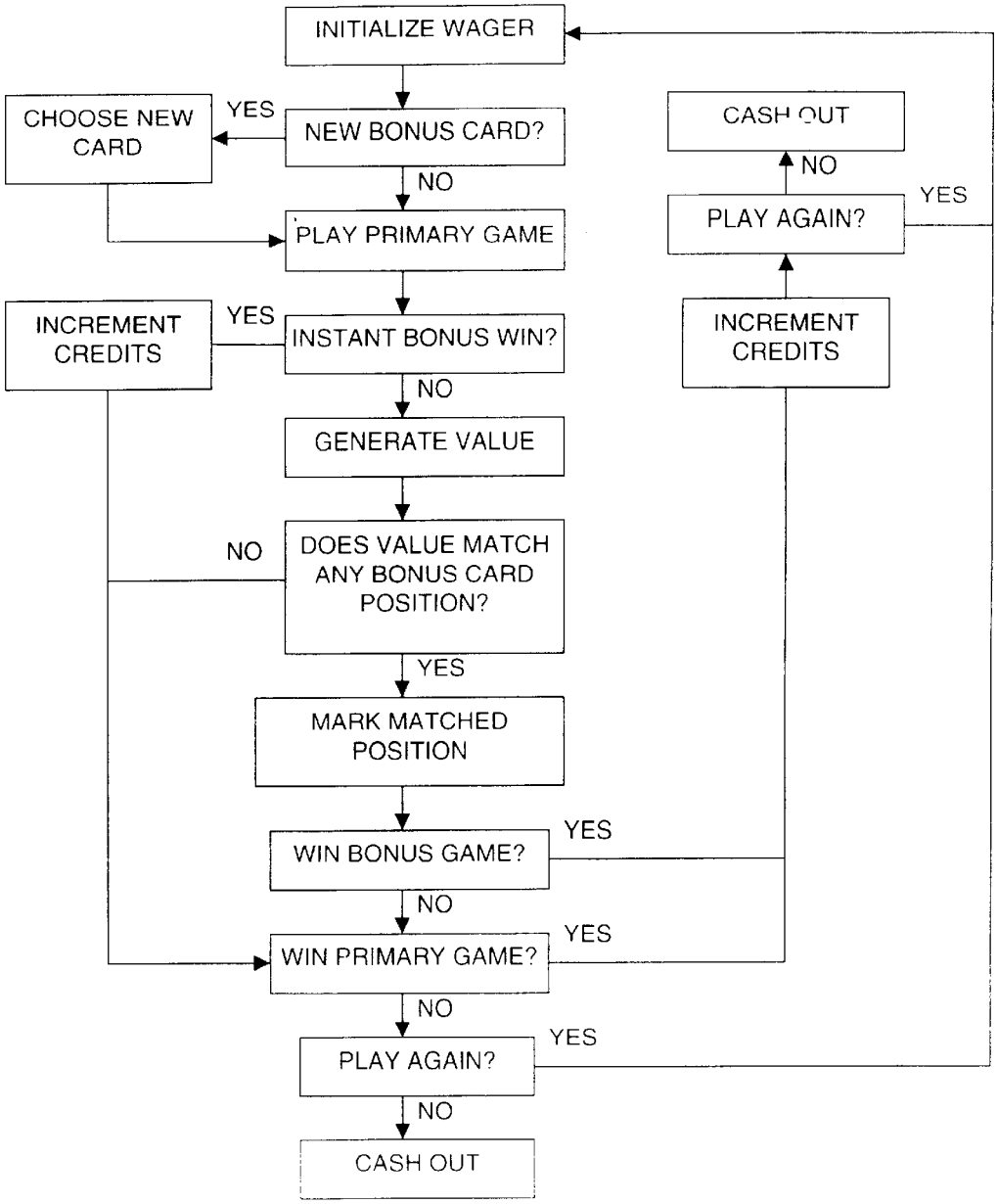
FIG. 1 is a flowchart of the methodology according to the present invention.

Referring to FIG. 1, the flow chart associated with the apparatus of FIGS. 2 and 3 can be explored. Initially, the display is as shown in FIG. 2, with a primary game matrix 21 positioned above a secondary game matrix 30. Initially, a player makes a wager to initialize the game. If the previous secondary game ended because of a winning outcome, or if the player so desires, a BINGO game with a different winning outcome is chosen at this time. Choosing a variation with a lower probability of success may result in a larger award to the player. Preferably, the variations of the secondary game include, but are not limited to, BINGO outcomes such as five-in-a-row any way, any vertical row, any horizontal row, four corners, any postage stamp (block of four), any kite (diagonal five with block of four at one corner), small or large diamonds, small or large picture frames, a plus sign, letter T, letter X, letter L, letter N, and covering the entire card.

In addition to indicia that produce winning outcomes on the primary game matrix 21, the primary game also contains secondary indicia 24 that only relate to the secondary game. The secondary game is played on the secondary game matrix 30. Each secondary indicium may reveal a value correlative of a possible value on the secondary game matrix 30. Initially, however, BINGO ball indicia 24 need to be "enabled" prior to exposing their face value (i.e. I24). Indicia that are "enabled" animate after appearing on the primary game matrix 21, spinning 180° to reveal a numeric or alphanumeric value. For example, secondary indicia 24 shown in FIG. 3 reveals B1, I25, N37 and G59. Only G59 matches a corresponding value on matrix 30. If indicia appear that are not "enabled," a message appears, instructing the player to deposit additional wagers to enable more indicia, and play continues. In the preferred embodiment, the secondary indicia are of two types, "red" and "blue" BINGO balls. The "red" secondary indicia are always enabled, that is, they always display values for possible matching on the secondary game matrix 30. The "blue" secondary indicia are only enabled, or will only display such values, if a supplemental (maximum) wager is employed. A subset of "blue" (or other color) indicia may also be enabled for intermediate-level wagers.

If the value displayed on the "enabled" secondary indicium matches a position 33 on the secondary game matrix 30, the indicium, or ball, travels from the primary game matrix 21 to the corresponding position 33 on the secondary game matrix 30, and that corresponding position 33 appears marked, or "covered," preferably in green. Additionally, the indicium, or ball, takes on a green "halo" to indicate that its value has already been matched on the secondary game matrix 30. As mentioned, the player engages in a gaming proposition on the primary game matrix 21 for which rewards are given for specific outcomes according to a paytable. As the player continues play on the primary game, e.g., by making additional wagers, any values on enabled secondary game indicia that appear are applied to the same secondary game. Play of the particular secondary game continues in this manner until a winning outcome appears on the secondary game matrix 30 or until the player chooses to play a different variation of the secondary game. Alternatively, a particular secondary game may be of fixed duration, e.g., lasting for a predetermined number of primary game sessions or until the occurrence of a specified event. Whenever the player chooses to play a different variation of the secondary game, the current secondary game matrix is cleared, and new randomly-generated positions 33 appear on the secondary game matrix 30. Additionally, if five specially colored (e.g. "blue") secondary indicia 24 appear simultaneously on the primary game matrix 21, the player wins. In this circumstance, the player wins whether or not a maximum wager was employed, and whether or not any of the values displayed on the indicia match positions displayed on the secondary game matrix 30.

If a winning outcome is attained on the secondary game matrix 30, an animated award screen appears, in which five BINGO balls animate, one for each letter of BINGO. The player is allowed to choose a BINGO ball. The chosen ball displays a value, which is the award credited to the player. The value is prominently displayed, accompanied by fanfare and celebratory animation, such as fireworks.

Moreover, having thus described the invention, it should be apparent that numerous structural modifications and adaptations may be resorted to without departing from the scope and fair meaning of the instant invention as set forth hereinabove and as described hereinbelow by the claims.

We claim:

1. A device for gaming, comprising, in combination:

a display, a wagering means, and a processor operatively coupled to said display and activated by said wagering means, said display providing an outcome when enabled, wherein said outcome includes a plurality of bonus indicia having means for bestowing credits, wherein said bonus indicia are a subset of said outcome, and said bonus indicia categorized into a plurality of classes, and means for enabling none, some, or all of said classes, each said class having differing said credit-bestowing means associated with said class such that said credit-bestowing means associated with a particular class of said bonus indicia is active when said particular class of bonus indicia is enabled.

2. The device of claim 1 wherein at least one of said classes of bonus indicia is always enabled.

3. The device of claim 2 wherein at least one of said classes of bonus indicia is enabled only when a maximum input to said wagering means is employed.

4. The device of claim 3 wherein a plurality of said classes of bonus indicia is enabled, directly related to the input of said wagering means.

5. The device of claim 4 wherein said bonus indicia appear in a primary gaming event and are applied to a secondary gaming event to provide an outcome for the secondary gaming event.

6. The device of claim 5 wherein said bonus indicia are applied to said secondary gaming event through successive iterations of said primary gaming event, providing outcomes until a winning outcome is attained in said secondary gaming event.

7. The device of claim 6 wherein said secondary gaming event further comprises a plurality of variations, wherein each variation is characterized by a distinct set of winning outcomes.

8. The device of claim 7 wherein choice means allow selection of one of said plurality of variations of said secondary gaming event when said wagering means are activated and before said display is enabled.

9. The device of claim 5 wherein said bonus indicia are applied to said secondary gaming event through a predetermined number of successive iterations of said primary gaming event.

10. The device of claim 9 wherein said secondary gaming event further comprises a plurality of variations, wherein each variation is characterized by a distinct set of winning outcomes.

11. The device of claim 10 wherein choice means allow selection of one of said plurality of variations of said secondary gaming event when said wagering means are activated and before said display is enabled.

12. A method for gaming, the steps including:

receiving a wager, enabling a display upon receipt of the wager, providing an outcome, said outcome including a plurality of bonus indicia in addition to non-bonus indicia, categorizing the bonus indicia as a function of classes, enabling none, some, or all of said classes, and bestowing on the classes different attributes leading to credits, whereupon during play the classes affect outcome.

13. The device of claim 12 wherein at least one of said classes of bonus indicia is always enabled.

14. The device of claim 13 wherein at least one of said classes of bonus indicia is enabled only when a maximum input to said wagering means is employed.

15. The device of claim 14 wherein a plurality of said classes of bonus indicia is enabled, directly related to the amount of the wager.

16. The device of claim 15 wherein said bonus indicia appear in a primary gaming event and are applied to a secondary gaming event to provide an outcome for the secondary gaming event.

17. The device of claim 16 wherein said bonus indicia are applied to said secondary gaming event through successive iterations of said primary gaming event, providing outcomes until a winning outcome is attained in said secondary gaming event.

18. The device of claim 17 wherein said secondary gaming event further comprises a plurality of variations, wherein each variation is characterized by a distinct set of winning outcomes.

19. The device of claim 18 wherein choice means allow selection of one of said plurality of variations of said secondary gaming event when the wager is received.

20. The device of claim 16 wherein said bonus indicia are applied to said secondary gaming event through a predetermined number of successive iterations of said primary gaming event.

21. The device of claim 20 wherein said secondary gaming event further comprises a plurality of variations, wherein each variation is characterized by a distinct set of winning outcomes.

22. The device of claim 21 wherein choice means allow selection of one of said plurality of variations of said secondary gaming event when the wager is received.

* * * * *